US006264385B1

(12) United States Patent
Ito

(10) Patent No.: US 6,264,385 B1
(45) Date of Patent: Jul. 24, 2001

(54) KEYBOARD DEVICE HAVING KEY-SHAPED SPACERS OF A TRANSPARENT RESIN

(75) Inventor: Hideki Ito, Fukushima-ken (JP)

(73) Assignee: ALPS Electric Co., Ltd., Tokyo (JP)

( * ) Notice: Subject to any disclaimer, the term of this patent is extended or adjusted under 35 U.S.C. 154(b) by 0 days.

(21) Appl. No.: 09/408,081

(22) Filed: Sep. 29, 1999

(30) Foreign Application Priority Data

Sep. 30, 1998 (JP) ..... 10-294538

(51) Int. Cl.[7] ..... B41J 5/16
(52) U.S. Cl. ..... 400/472; 400/691
(58) Field of Search ..... 400/472, 495, 400/491, 490, 487, 691

(56) References Cited

U.S. PATENT DOCUMENTS 4,447,681 * 5/1984 Desmarais ..... 200/5 A
4,489,227 * 12/1984 Lamarche ..... 200/314
4,701,579 * 10/1987 Kurachi et al. ..... 200/5 A
4,892,999 * 1/1990 Wai-Kwan ..... 235/1 D
5,172,114 * 12/1992 Bedoya et al. ..... 341/27
5,544,020 * 8/1996 Loeber et al. ..... 362/29
5,565,865 10/1996 So .

* cited by examiner

*Primary Examiner*—John S. Hilten
*Assistant Examiner*—Anthony H. Nguyen
(74) *Attorney, Agent, or Firm*—Brinks Hofer Gilson & Lione

(57) ABSTRACT

A transparent keyboard device is disclosed which is superior in design synthetically, including spacer portions. The keyboard device comprises a keyboard body with a large number of key tops attached to the upper surface thereof, an upper case, and a lower case, the upper and lower cases accommodating the keyboard body therein, the key tops being formed of a transparent resin, and the keyboard body having a housing formed of an opaque resin and which supports the key tops. Key-shaped spacers formed of the same transparent resin as that of the key tops are mounted on the upper surface of the keyboard body.

8 Claims, 3 Drawing Sheets

KEYBOARD DEVICE HAVING KEY-SHAPED SPACERS OF A TRANSPARENT RESIN

BACKGROUND OF THE INVENTION

1. Field of the Invention

The present invention relates to a keyboard device and particularly to the construction of a spacer which is for partitioning keys different in function and shape such as ordinary input keys, ten keys and function keys.

2. Description of the Prior Art

A conventional keyboard generally has a keyboard body with a large number of key tops attached thereto and a case which accommodates and holds the keyboard body therein. The case is of a combined structure comprising an upper case which covers the upper surface side of the keyboard body and a lower case which covers the lower surface side of the keyboard body, the upper case having window portions through which a large number of key tops are exposed. The reason for adopting this structure is that this structure facilitates the keyboard assembling work. The keyboard body has several kinds of key groups of different functions such as ordinary input keys, ten keys and function keys. Usually, adjacent key groups are partitioned and somewhat spaced from each other by a beam portion positioned between upper case windows.

Recently, in the field of information processors such as personal computers, there has been an increasing demand for the reduction of size, thickness and weight from the standpoint of space saving and portability improvement. With such a demand as background, also in the field of keyboard as an input device of an information processor, a demand has been being raised to the effect that the keyboard itself should be reduced in size, thickness and weight. In this connection, for reducing the size of conventional keyboards having the above structure, there has been proposed a keyboard in which the number of beam portions for partitioning key groups is decreased, the spacing between adjacent key groups is narrowed, and the width of an outer frame portion of the case is reduced.

According to this keyboard, the reduction in size of the keyboard can be realized in comparison with the other conventional keyboards of the foregoing structure because the key group-to-key group spacing is narrowed and the external frame is reduced in width.

Recently, as an example of a keyboard with importance attached to design there has been proposed a keyboard in which the components constituting an appearance such as an upper case, a lower case and key tops are formed using a transparent resin. In this keyboard having a transparent appearance, for example if the lower case is colored in blue, the outer frame portion which surrounds the key tops is seen through in a light blue color, thus giving a refreshing and cheerful feeling to the user. Also in point of design this keyboard is of a smart design meeting the requirement for reduced size and weight.

Even in the keyboard having a reduced number of beam portions each for defining a partition between adjacent key groups it is sometimes required to ensure a space between keys of different functions or between keys of different shapes and sizes, and as the case may be it is required that a certain projection (spacer) for partitioning be disposed in the space. On this regard, in the conventional keyboard, when a housing (a key top support), which is positioned below a large number of key tops to support the key tops, is formed by molding with a resin, the resin is molded so that the portion to serve as the space is raised, and the raised portion is used as a spacer. Thus, the spacer has been formed integrally with the housing.

In the above transparent keyboard, the upper surface of the housing portion is covered with a large number of key tops and the housing is accommodated within a case and is usually not visible from the outside. For this reason, a transparent resin which gives a good appearance is not used as the material of the housing. Therefore, in the case where the above conventional spacer forming method is applied to a transparent keyboard, although the components visible from the outside such as the case and the key tops are formed using a transparent resin, an opaque resin used as the material of the housing is exposed to only the spacer portion and spoils the appearance even if the design is good.

SUMMARY OF THE INVENTION

The present invention has been accomplished for solving the above-mentioned problems and it is an object of the present invention to provide a transparent keyboard device including appearance-constituting components such as a case and key tops formed of a transparent resin and which keyboard device is superior in design synthetically as a whole including the spacer portions.

According to the present invention, for achieving the above-mentioned object, there is provided a keyboard device having a keyboard body with a plurality of key tops attached to the upper surface thereof, the key tops being formed of a transparent resin and at least the upper surface of the keyboard body being formed of an opaque resin, and a case which accommodates the keyboard body therein, characterized in that key-shaped spacers formed of the same transparent resin as the transparent resin of the plural key tops are mounted on the upper surface of the keyboard body.

In the conventional keyboard device, a portion of the housing (a constituent of the keyboard body) corresponding to the space portion is raised to form a spacer integral with the housing, while in the keyboard device of the present invention, spacers separate from the keyboard body are formed and attached to the keyboard body. Further, the spacers used in the present invention are formed in a key shape of a similar appearance to the other key tops and using the same transparent resin as that of the key tops. For example, a transparent resin colored in a blackish color is used as the material of the key tops in the transparent keyboard. According to the above construction of the present invention, the components located in the key top area, including the spacer portions, are all unified in shape, color and texture and a keyboard device superior in design can be obtained easily and less expensively.

As an example of a more concrete mode, there may be adopted a construction wherein the keyboard body comprises a plurality of key tops, a key top support formed of an opaque resin and which supports the plural key tops, a membrane switch, and a plate member which holds and supports the membrane switch between it and the key top support, with box-shaped key-like spacers being inserted into holes of the key top support so that their upper surfaces are exposed to the exterior.

This construction contributes to the saving of time and labor because the fabrication of the key-shaped spacers can be done simultaneously with the fabrication of the key tops with use of a mold. Further, the mounting of the key-shaped spacers can also be done easily by merely inserting the spacers into holes formed in the key top support.

In this case, the lower end of each key-shaped spacer may be formed with a flange portion and this flange portion may be held between the key top support and the plate member, whereby the key-shaped spacers are fixed positively to the keyboard body without the fear of dislodgment thereof from the keyboard body.

BRIEF DESCRIPTION OF THE DRAWINGS

FIG. 3 is a diagram showing a key-shaped spacer mounting structure in the keyboard device, in which

DETAILED DESCRIPTION OF A PREFERRED EMBODIMENT

An embodiment of the present invention will be described hereunder with reference to FIGS. 1 to 3.

Figure 1:
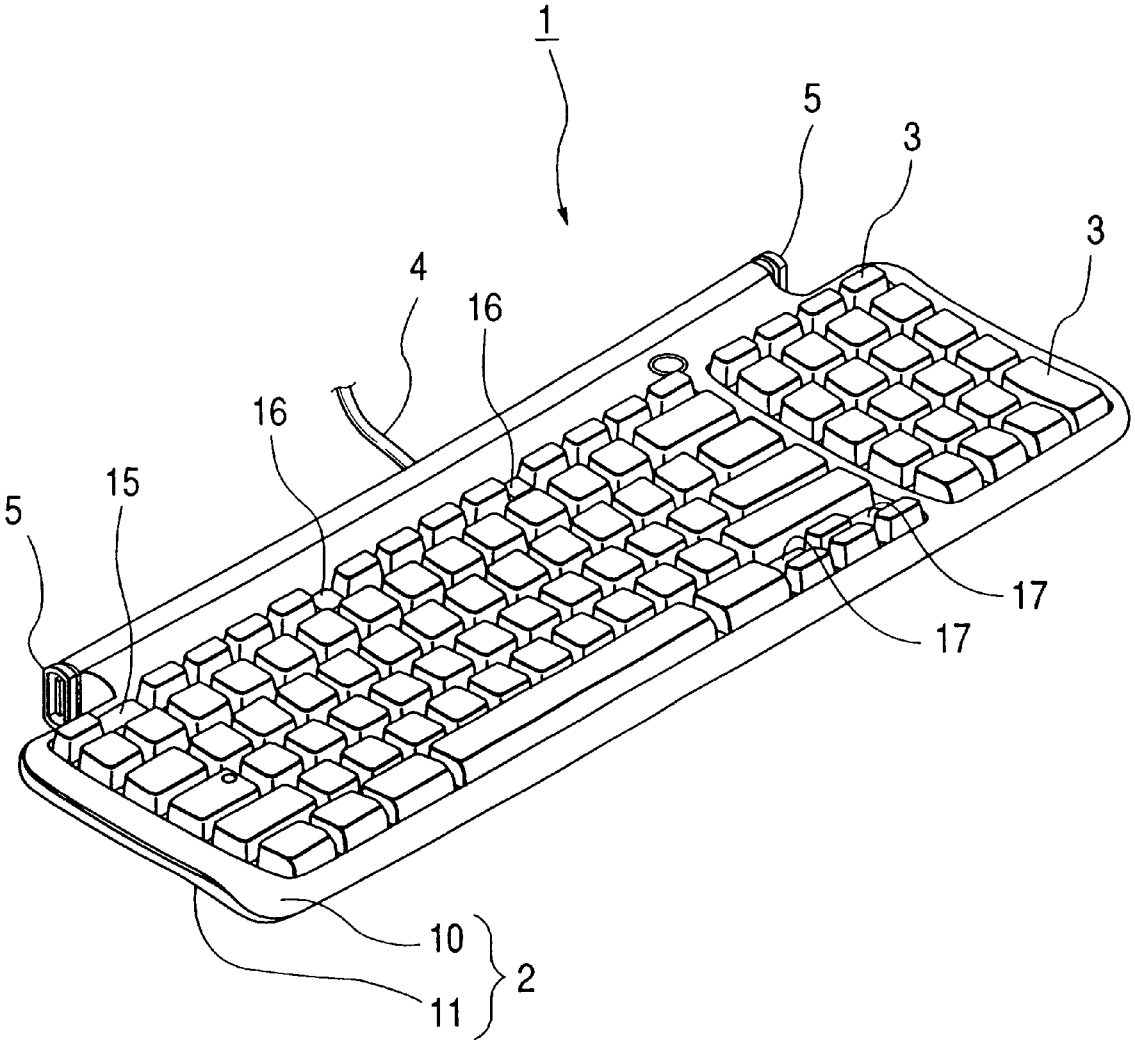
FIG. 1 is a perspective view showing an entire construction of a keyboard device according to an embodiment of the present invention.

FIG. 1 is a diagram showing an entire construction of a keyboard device embodying the present invention. The keyboard device 1 is a transparent keyboard of small size and small thickness in which a case 2 and key tops 3 are formed of a transparent resin. A cable 4 for connection to, say, a computer body (not shown) is drawn out from a rear side of the keyboard device 1 (the inner side and this side as seen from the user side may sometimes be referred to as rear side and front side, respectively), and connectors 5 conforming to the USB standard for common connection to various external devices are attached to side faces on the rear side of the keyboard device 1.

Figure 2:
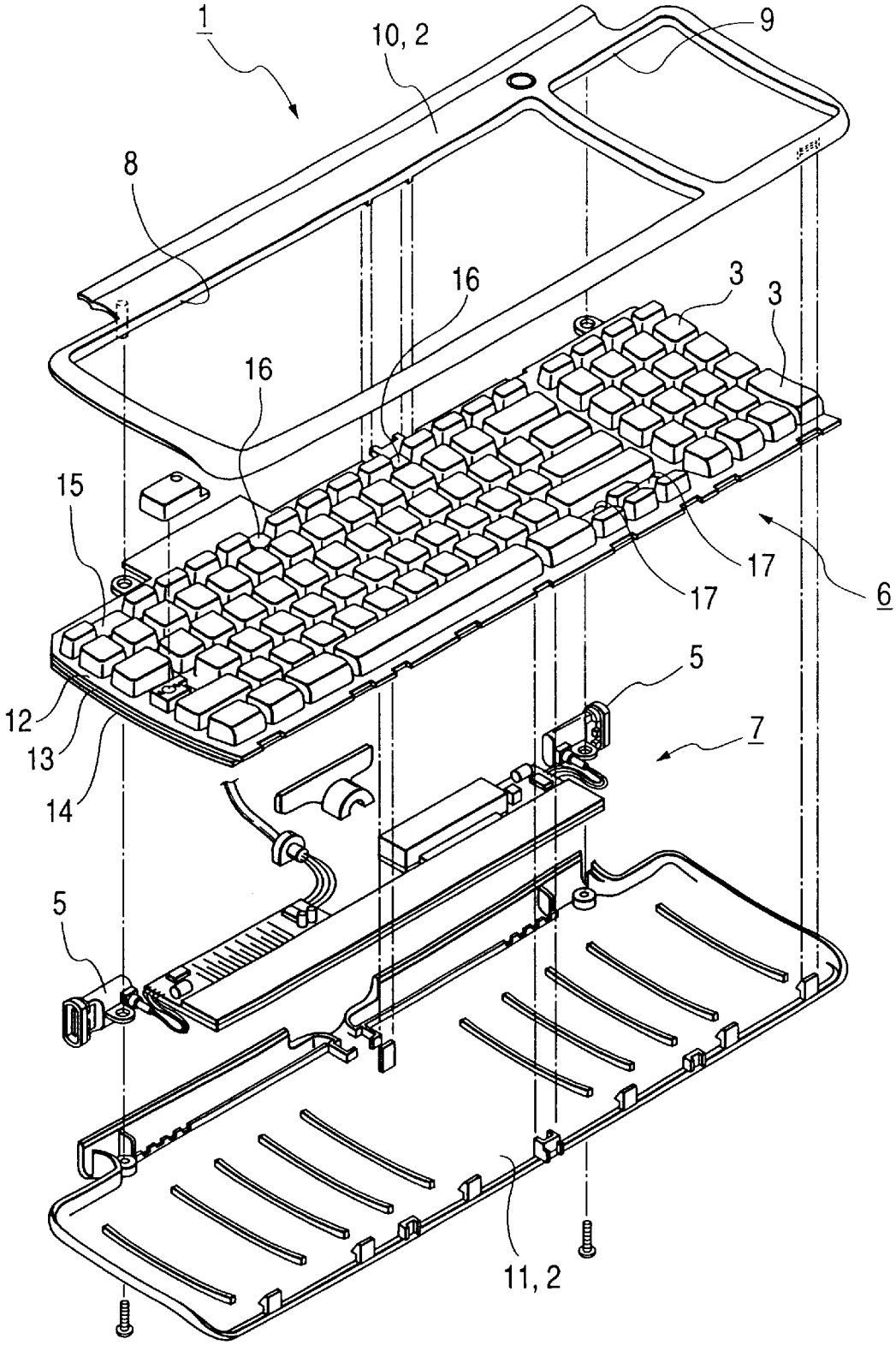
FIG. 2 is a perspective view showing an exploded state of an upper case, a keyboard body, a lower case, etc. in the keyboard device.

The keyboard device 1 of this embodiment, as shown in FIG. 2, is substantially composed of a keyboard body 6 with a large number of key tops attached to the upper surface thereof, a case 2 which accommodates the keyboard body therein, and a control unit 7 which controls the transmission and reception of various signals to and from a computer body for example. The case 2 comprises an upper case 10 which covers the upper surface side of the keyboard body 6 and a lower case 11 which covers the lower surface side of the keyboard body 6, the upper case 10 having window portions 8 and 9 through which the key tops 3 are exposed.

The upper case 10 is formed using a white, transparent ABS resin. The window portion 8 of the upper case 1 is for exposing ordinary input keys and function keys, while the window portion 9 is for exposing ten keys. The key tops 3 are exposed from the window portions 8 and 9. The lower case 11 is formed of a translucent ABS resin colored in blue color and the key tops 3 are formed of a translucent ABS resin colored in black color. Characters and symbols such as alphabet and numerals are described on the upper surfaces of the key tops 3 by laser machining, which characters and symbols are not shown for the convenience of illustration.

The keyboard body 6, as shown in FIG. 2 comprises a housing 12 (a key top support) which supports a large number of key tops 3, a membrane switch 13 constituted by three sheets which are two circuit sheets and one spacer sheet, and a metallic plate (plate member) 14 which holds and supports the membrane switch 13 between it and the housing 12. The housing 12 is formed using a polycarbonate resin whish is an opaque, gray resin.

As shown in FIG. 1, function keys are disposed at the rearmost row of key tops 3 (characters and symbols to be described on the key tops 3 are omitted for the convenience of illustration). A rectangular key-shaped spacer 15 is mounted between, say, "ESC" key located at the leftmost end position of the rearmost row and "F1" key, and generally square key-shaped spacers 16 are mounted respectively between "F4" key and "F5" key and between "F8" key and "F9" key. Further, rectangular key-shaped spacers 17 are mounted respectively between an arrow key, say, "←" key located at a right-hand position of the frontmost row and "shift" key and between "→" key located at a right-hand position of the frontmost row. The key-shaped spacers 15, 16 and 17 are formed using the same translucent, black ABS resin as that of key tops 3. Characters, symbols and the like are not described at all on the upper surfaces of the key-shaped spacers 15, 16 and 17 and these spacers are each set at a height sufficiently lower than the height of each key tops 3, so are easily distinguished from the key tops 3.

Figure 3A:
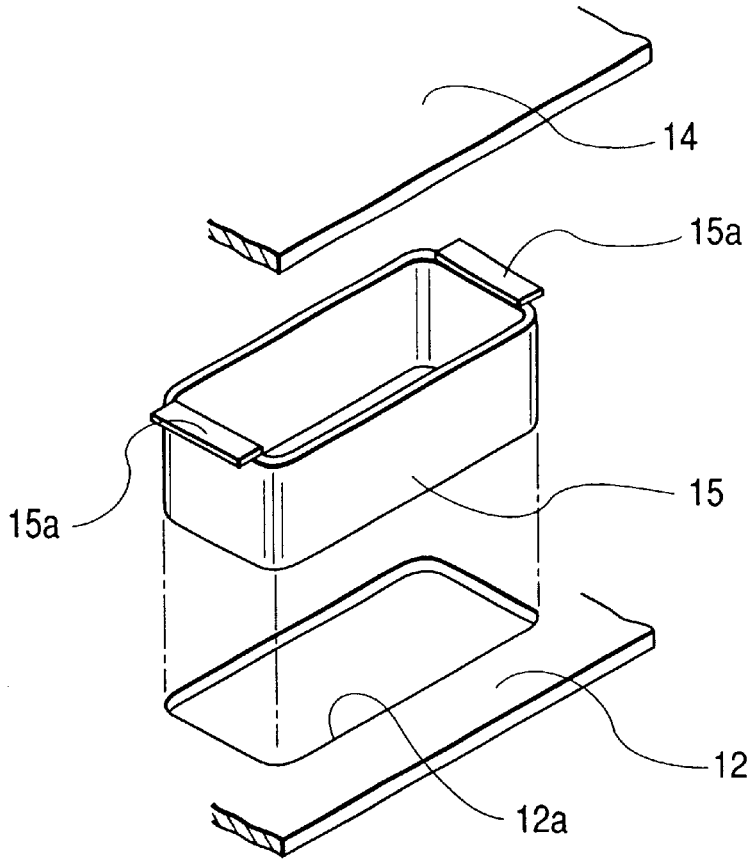
FIG. 3A is a perspective view showing an exploded state and FIG. 3B is a perspective view showing an assembled state.
Figure 3B:
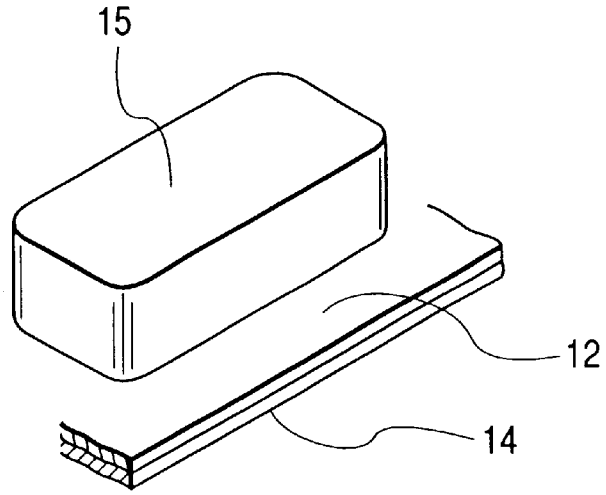

FIG. 3A is a diagram showing the rectangular key-shaped spacer 15 as seen upside down. As shown in the same figure, the spacer 15 is in the shape of a hollow box having one open side, with flange portions 15*a* projecting horizontally from two opposed edges. Each key top 3 is supported vertically movably on the upper surface of the housing 12 because the key top is required to generate a signal when depressed, with the membrane switch 13 and a rubber spring (not shown) being disposed under the key tops 3. On the other hand, the key-shaped spacer 15 is not required to operate, so as shown in FIG. 3A, it is inserted into a rectangular hole 12*a* formed in the housing 12 and its flange portions 15*a* are held between the housing 12 and the metallic plate 14. In this state the spacer 15 is fixed while its upper surface is exposed to the exterior, as shown in FIG. 3B. The other key-shaped spacers 16 and 17 are also provided with similar flange portions.

For mounting the key-shaped spacers 15, 16 and 17, therefore, holes 12*a* are formed in the positions where those spacers are to be mounted, at the time of fabricating the housing 12 by molding for example, while simultaneously with formation of the key tops 3 there are formed key-shaped spacers 15, 16 and 17 of similar shapes to the shape of key tops 3 with use of the same material as that of the key tops. Then, at the time of assembling the keyboard body 6, the key-shaped spacers 15, 16 and 17 may be mounted in the above manner. Thus, since the key-shaped spacers 15, 16 and 17 can be fabricated by molding simultaneously with the fabrication of the key tops 3, no special extra work is needed. Further, the key-shaped spacers 15, 16 and 17 can be mounted easily by merely inserting them into the holes 12*a* of the housing 12 and putting the metallic plate 14 thereon.

In the conventional keyboard device a spacer integral with the housing is formed, so if this conventional method is applied to the keyboard device of this embodiment, an opaque gray resin which constitutes the housing is exposed to only the spacer portion despite the key top color being a transparent color, with consequent deterioration in point of design. In the keyboard device 1 of this embodiment, key-shaped spacers 15, 16 and 17 separate from the housing 12 are attached to the keyboard body 6 and are formed in a key shape similar to the appearance of key tops 3. Also as to the material thereof, the same transparent resin as that of the key tops is used. As a result, the components located within the key top area, including the spacer portions exposed from the window portions of the upper case 10, are unified in all of shape, color and texture, and thus a keyboard device superior in design can be obtained easily and less expensively.

In this embodiment, moreover, since the flange portions 15*a* are formed at the lower ends of the key-shaped spacers 15, 16 and 17 and are held between the housing 12 and the metallic plate 14, those spacers are sure to be fixed to the keyboard body 6 and there is no fear of their dislodgment from the keyboard body.

The technical scope of the present invention is not limited to the above embodiment, but various modifications and changes may be made within the scope not departing from the gist of the present invention. For example, the shapes, numbers and mounting positions of the key-shaped spacers used in the above embodiment are mere examples and it goes without saying that various design modifications may be made as necessary.

In the keyboard device of the present invention, as set forth in detail hereinabove, spacers separate from the keyboard body are fabricated and then attached to the keyboard body. Further, the spacers are each formed in a key shape similar to the appearance of the other key tops and using the same transparent resin as that of the key tops. Consequently, the components located within the key top area including the spacer portions are unified in all of shape, color and texture and thus a keyboard device superior in design synthetically can be obtained easily and inexpensively.

What is claimed is:

1. A keyboard device comprising:

a keyboard body having an upper surface formed of an opaque resin;

a plurality of key tops attached to the upper surface of the keyboard body, said key tops having an upper surface, being formed of a transparent resin and vertically movable;

a plurality of switches, each switch driven by a vertical motion of a unique key top;

a case accommodating said keyboard body therein such that said upper surfaces of said key tops are exposed; and key-shaped spacers mounted on the upper surface of said keyboard body, said key-shaped spacers formed of the transparent resin and having an external shape to discriminate one of groups of different key tops having predetermined functions and a group of predetermined groups of said key tops and a key top adjacent to one key top of the group of predetermined groups, said key-shaped spacers arranged in one of an interface space between said groups of different key tops and an interface space between said one key top of predetermined groups and said key top adjacent to said one key top of predetermined groups.

2. The keyboard device according to claim 1, said keyboard body further comprising:

a key top support having holes and formed of an opaque resin, said key top support supporting said key tops;

a sheet-like membrane switch containing the plurality of switches; and a plate member holding and supporting said membrane switch between said plate member and said key top support.

3. The keyboard device according to claim 1, further comprising:

a first key-shaped spacer arranged in an interface space between a lateral elongated key top to define a shift key and a key top to define a first arrow key arranged in a vertical direction with respect to said shift key and at one end of said shift key; and a second key-shaped spacer arranged in an interface space between a key top to define a second arrow key arranged in the vertical direction with respect to said shift key and at an opposing end of said shift key.

4. The keyboard device according to claim 2, wherein:

said key top support is formed with holes where said key-shaped spacers are fitted into said interface space between said groups of different key tops having predetermined functions and said interface space between said one key top of predetermined groups and said key top adjacent to said one key top of predetermined groups; and said key-shaped spacers have lower ends and flanges at outer circumferences of the lower ends, said spacers are fitted into said respective holes of said key top support to cause said flanges to be abutted against and engaged at said key top support.

5. The keyboard device according to claim 1, wherein said key-shaped spacers have a box-shaped, substantially square outer shape as viewed in a top plan view and a height lower than a height of any of said plurality of key tops.

6. The keyboard device according to claim 1, wherein said plurality of key tops and said key-shaped spacers are formed of a black-colored translucent ABS resin.

7. The keyboard device according to claim 1, wherein one of said key-shaped spacers is arranged in an interface space between a key top to define a F1 key in a group of function keys and a key top to define an ESC key adjacent to the key top of the F1 key.

8. The keyboard device according to claim 1, further comprising:

a first, second and third group of function keys and corresponding key tops, the first group of function keys including F1, F2, F3 and F4 keys arranged in a lateral direction, the second group of function keys including F5, F6, F7 and F8 keys arranged in the lateral direction, and the third group of function keys including F9, F10, F11 and F12 keys arranged in the lateral direction; and a first and second key-shaped spacer, the first key-shaped spacer arranged in an interface space between the F4 key top and the F5 key top and the second key-shaped spacer arranged in an interface space between the F8 key top and the F9 key top.

* * * * *